US005764134A

United States Patent [19]

Carr et al.

[11] Patent Number: 5,764,134

[45] Date of Patent: Jun. 9, 1998

[54] POLICE AUDIO IDENTIFICATION AND DISTRACTION DEVICE

[75] Inventors: Brian R. Carr, West University; Mig Allen Howard, San Leon, both of Tex.

[73] Assignee: Brian A. Carr, West University, Tex.

[21] Appl. No.: 646,889

[22] Filed: May 8, 1996

[51] Int. Cl.[6] ..... G08B 3/00

[52] U.S. Cl. ..... 340/384.1; 340/321; 340/384.7; 340/692; 340/693

[58] Field of Search ..... 340/384.1, 384.5, 340/384.7, 384.71, 384.72, 384.73, 692, 693, 333, 332, 331, 321

[56] References Cited

U.S. PATENT DOCUMENTS

| | | | |
|---|---|---|---|
| 4,797,657 | 1/1989 | Vorzimmer et al. | 340/693 |
| 4,932,328 | 6/1990 | Pinkney et al. | 102/482 |
| 4,947,753 | 8/1990 | Nixon, III | 102/487 |
| 5,085,147 | 2/1992 | Gold et al. | 102/486 |
| 5,145,473 | 9/1992 | Henry | 482/49 |
| 5,203,560 | 4/1993 | Wang | 273/58 E |
| 5,236,383 | 8/1993 | Connelly | 273/58 G |
| 5,246,372 | 9/1993 | Campagnuolo et al. | 434/11 |
| 5,375,839 | 12/1994 | Pagani | 273/586 |
| 5,575,240 | 11/1996 | Udelle et al. | 119/707 |

*Primary Examiner*—Edward Lefkowitz
*Attorney, Agent, or Firm*—James E. Bradley

[57] ABSTRACT

An audio police identification and distraction device that is sufficiently rugged to be thrown inside a structure to be searched and deliver electronically a digitally stored, high volume voice message that clearly identifies the police or law enforcement agency and distracts persons inside the structure during a hard entry. The audio device includes a voice message memory chip, a rechargeable battery operated power supply, an amplifier, a speaker assembly and a user activated switch and delay circuit. The audio signal output can achieve a speaker volume of at least 100 decibels, preferably in the range of 110 to 112 decibels. The electronic components are contained in a hard housing that can be tossed through a glass window and onto a floor without damage. The audio electronic circuit is battery operated and mounted on a platform that is isolated from the impact shocks imposed upon the housing.

21 Claims, 3 Drawing Sheets

POLICE AUDIO IDENTIFICATION AND DISTRACTION DEVICE

BACKGROUND OF THE INVENTION

1. Field of the Invention

This invention relates in general to audio devices and in particular to those useful in assisting law enforcement personal in conducing searches and seizures in a safer manner.

2. Background Information

Police officers, especially those in narcotics divisions, must frequently execute "hard entry" search warrants. The warrant authorizes entry into structures, including dwellings, by forceful entry. It is necessary, before entry, to alert those who may be inside that it is the police who demand entry to conduct a court authorized search and the seizure of evidence. All too frequently police are exposed to gunfire or other acts of violence by those concealed inside. It is not uncommon for an arrested suspect to testify that an injured or dead police officer was thought to have been an intruder committing an unlawful act of breaking and entering. A police officer and the city or agency he represents are all to frequently sued by a suspect to recover for personal injury and/or property damage after a search and seizure during which a police officer was injured seriously, while the suspect was hardly touched.

"I did not know they were the police and never heard them identify themselves".

This is the testimony—or something near it—that an injured police officer must endured at trial, even though the identifying shout, "Police! Police!" was given loudly by those dressed in clearly identified police uniforms. The best known tactics for minimizing the risk to law enforcement officers involve the use of amplification devices, such as a megahorn, and distraction devices, such a stun grenade. The use of a megahorn is susceptible to the excuse, "I never heard it—the windows and doors were closed and the stereo was on". The use of a stun grenade involves loud sounds and flashes of light that have caused injury to ears or eyes.

A better tactical warning device is needed for those who must make "hard entry" searches and seizures: one that gives a clear warning, while providing a distraction that minimizes the risk of injury to police and to those inside a structure that must be entered.

SUMMARY OF THE INVENTION

The general object to be achieved with the invention is the provision of an audio police identification and distraction device that is sufficiently rugged to be thrown inside a structure to be searched and to deliver a high volume voice message, stored in either a digital or analog format, that clearly identifies the police or law enforcement agency and distracts any person inside the structure during a hard entry. In one embodiment, the audio device includes a voice message memory chip, a rechargeable battery operated power supply, an amplifier, a speaker assembly and a user activated switch and delay circuit. The audio signal output can achieve a speaker volume of at least 100 decibels, preferably in the range of 110 to 112 decibels. The electronic component are contained in a hard housing that can be tossed through a glass window and onto a floor without damage. The audio electronic circuit is battery operated and mounted on a platform that is isolated from the impact shocks imposed upon the housing.

The above as well as additional objects, features, and advantages of the invention will become apparent in the following detailed description.

DESCRIPTION OF THE PREFERRED EMBODIMENT

Figure 1:
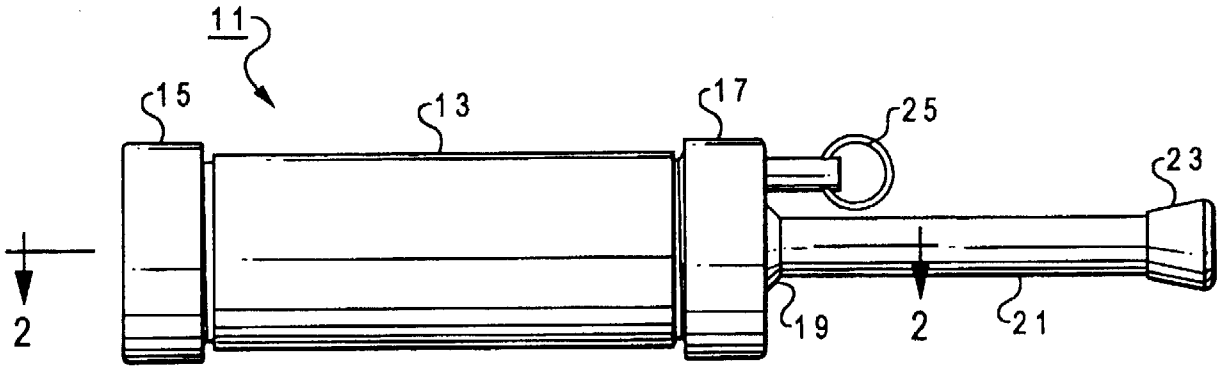
FIG. 1 is a side view of a police identification and distraction device that embodies the principles of the invention.

Referring initially to FIG. 1 of the drawings, the numeral 11 designates an audio identification and distraction device, one especially adapted for use by police or law enforcement personnel who may be compelled to make a "hard entry" to conduct a search and seizure. A housing 13 is fabricated in this embodiment of an aluminum pipe that is enclosed at one end with a speaker cap 15 and at the other end with a handle cap 17. Each cap is manufactured of a mild steel, which is hard and impact resistant to resist damage when thrown through a glass window and onto the floor of a building to be searched after a hard entry. The handle cap 17 is welded at 19 to one end of a tubular steel handle 21, the opposite end of which is covered with a resilient covering 23. Extending longitudinally from a location inside the periphery of the handle cap 17 is a pull pin 25. Nothing recited above is meant to limit the range of materials which can be used to construct the device. Other materials, such as plastic, are suitable can be used in place of the materials listed above.

Figure 2:
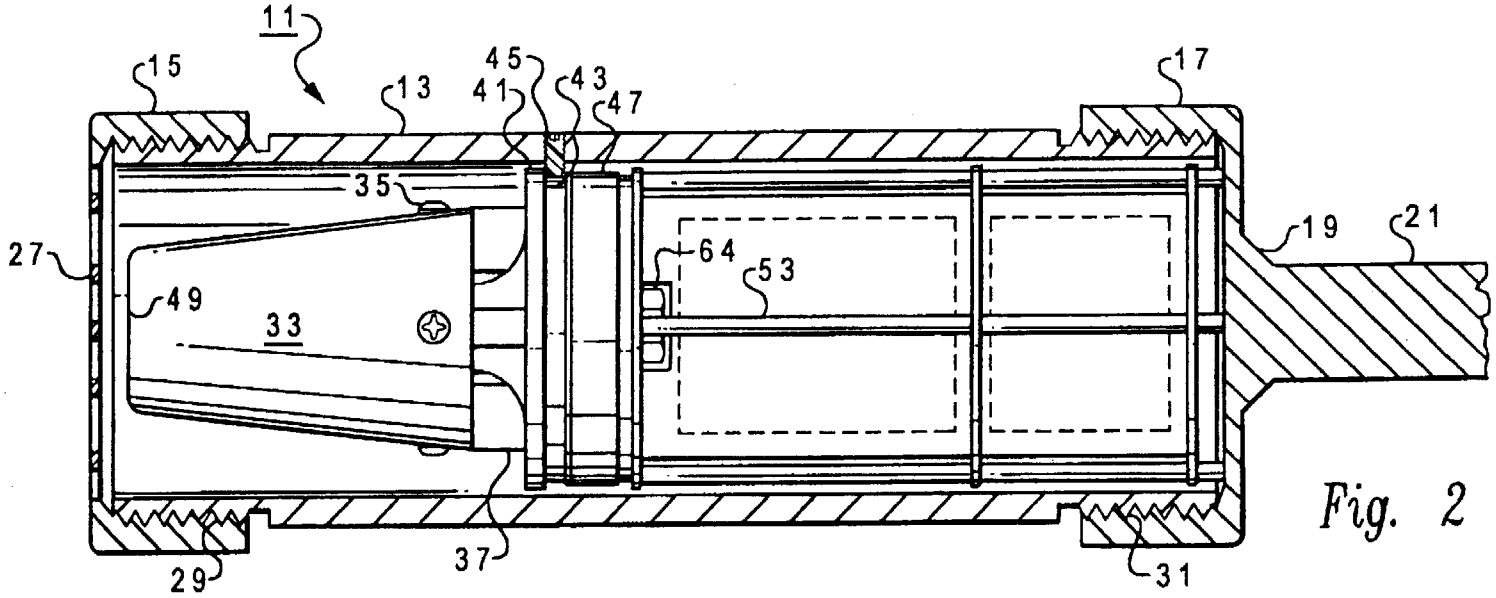
FIG. 2 is a fragmentary side view, partially in section, of the FIG. 1 embodiment of the invention.

FIG. 2 exposes the interior of device 11, showing in longitudinal cross section as seen looking along the arrows 2—2 of FIG. 1, a steel grate 27 forming the end of the speaker cap 15 in a crisscross pattern. Eighteen gage steel expanded metal with openings of about ¼ inch presents a construction that resists damage upon impact with a glass window or floor. The speaker cap 15 and the associated end of the housing 13 having mating threads 29 to permit removal and access to the interior of the device. Similarly, the handle cap 17 and associated end of the housing 13 have mating threads 31 to permit removal of the handle cap 17 and integral handle 21.

Figure 3:
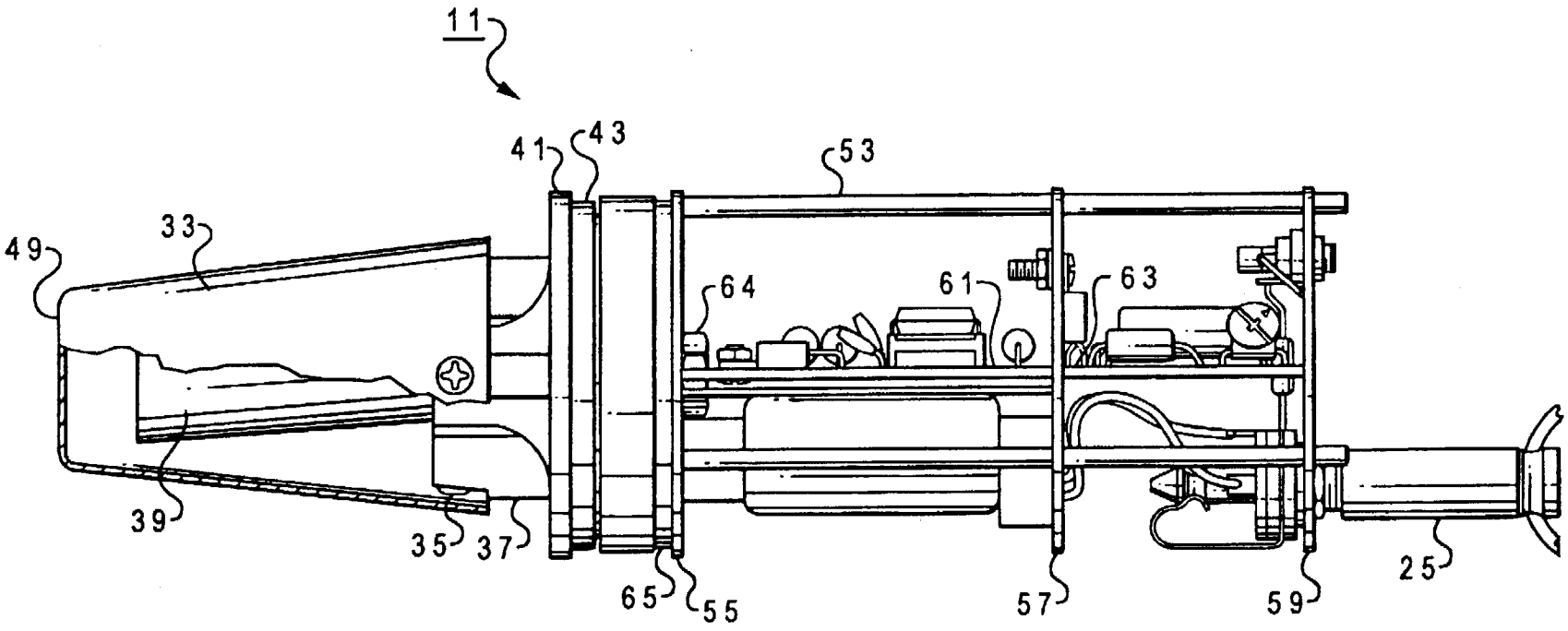
FIG. 3 is a side view, partially in section of the interior component carrier, including some of the mechanical and electrical circuit components and a speaker cover, partially broken away to show a portion of the speaker horn.

Near the speaker cap 15, is a metal, resonant speaker cover 33, secured with a plurality of set screws 35 to a base 37 of a speaker horn 39 (see FIG. 3). The base 37 is formed of a plastic and includes a flange 41 with a circular periphery and with an annular recess 43, into which extend a plurality of equally spaced set screws 45. A speaker magnet 47 is spaced axially from the set screws 45, the interior ends of which are secured to the plastic that forms the annular recess. There is preferably some clearance between the periphery of the flange 41 and the interior of the housing 13 such that the set screws 45 facilitate assembly and help isolate the speaker from the impact loading and mechanical vibrations generated when the device 11 is thrown through a window and falls to the floor of a building to be searched. There is also clearance between the end 49 of the speaker cover 33 and the steel grate 27 of the speaker cap 15 for this same reason.

A shock absorbing circuit board cage is formed, as shown in FIGS. 2 & 3, with a plurality of brass ribs 53 that interconnect axially space bulkheads 55, 57, 59 constructed of convention circuit board material. The circuit board segments 61, 63 (shown in FIG. 3) are secured between the bulkheads to support the circuit components that are described later with reference to the circuit diagram of FIG. 4. The circuit board cage is attached to the speaker assembly with bolt 64 inserted into a threaded hole (not shown) in the center of the plastic speaker flange 65.

The advantages of the above described apparatus include the use of a mounting system that achieves the isolation of the circuit board cage from the mechanical shock waves generated by impact with a glass window or the floor of a structure to be searched. This isolation is achieved by using the set screws 45 that extend into the plastic annular recess 43 of the speaker assembly to at least partially suspend the assembly from the aluminum housing 13. Shock waves do not easily permeate the small volume of the metal screws, and those that do tend to be absorbed in the plastic that forms the annular recess. This reduces the amplitude of the mechanical shock waves that reach the speaker assembly and the circuit board cage by what is defined here as the "isolation feature" of the mounting system.

The construction of the circuit board cage of shock absorbing material has the effect of dampening or attenuating the amplitude of those mechanical shock waves that are transmitted past the set screws 45 and plastic annular recess 43. The above describe materials and construction of the circuit board cage absorb acoustical waves, including the shock waves that survive the isolation system described above. The combination of a shock wave isolation feature and a shock absorbing feature contribute to the successful practice of the invention.

Figure 4:
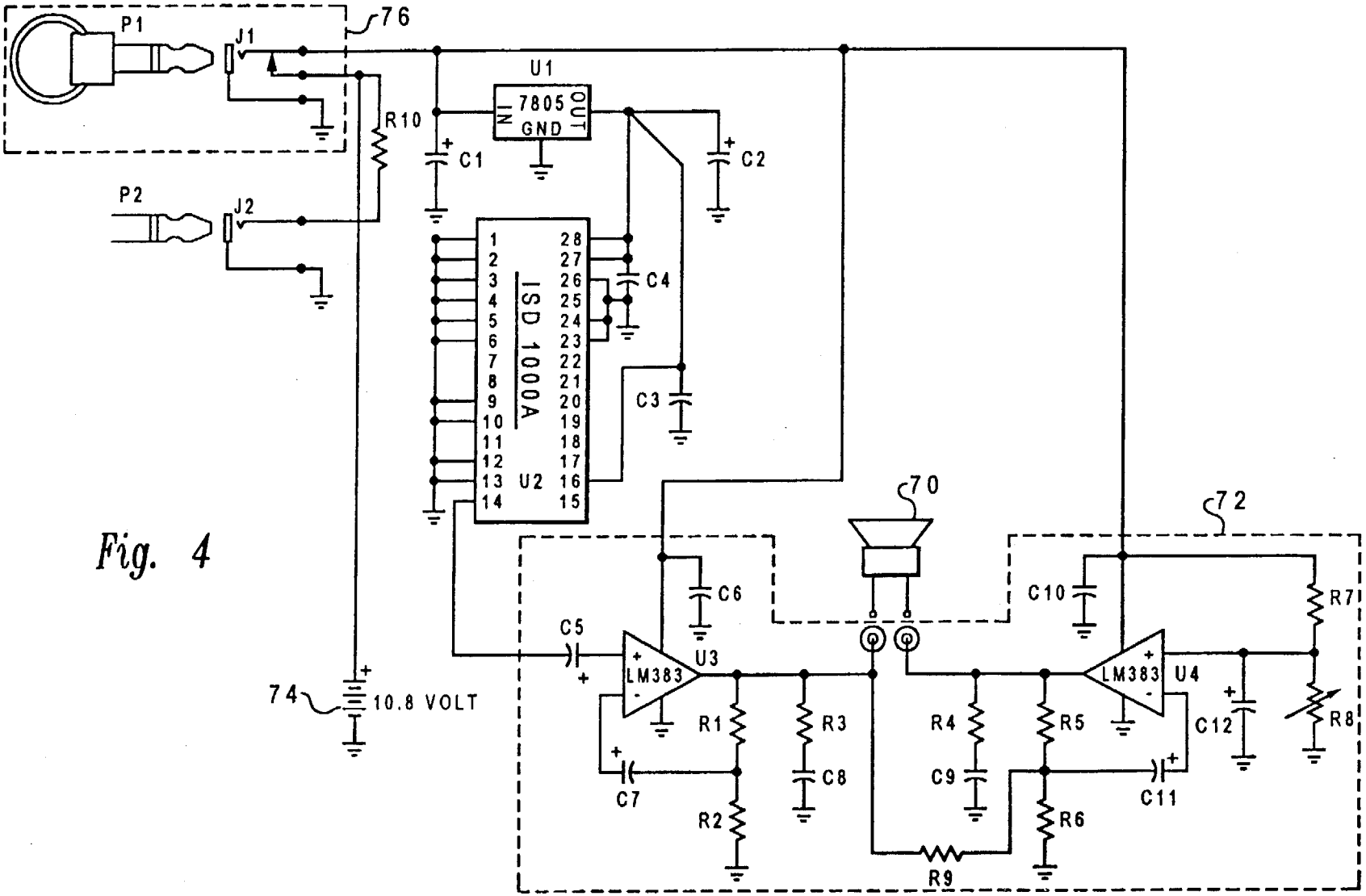
FIG. 4 is a schematic diagram of the preferred electrical circuit used to implement the invention.

With reference now to FIG. 4, there is depicted a schematic diagram of one embodiment of an electrical circuit for driving a speaker horn in accordance with the present invention. As illustrated, speaker horn 70 is coupled to the output of amplifier circuit 72. The input to amplifier 72 is a signal that is generated by speech synthesizer U2. Both amplifier circuit 72 and speech synthesizer U2 are powered by battery 74. Power switch means 76 is used to switch on and off power supplied by battery 74.

In the embodiment illustrated, power switch means 76 is implemented by jack J1 and plug P1. When plug P1 is inserted into jack J1, power switch means 76 is turned off, and no power is applied to speech synthesizer U2 or amplifier circuit 72. When plug P1 is removed from jack J1, power switch means 76 is switched on, thereby applying power to the circuits illustrated in FIG. 4.

Battery 74 is preferably implemented by a rechargeable battery that stores enough power to drive speaker horn 70 with a sound pressure level of greater than 100 dB/W/m for a duration of at least 20 seconds. In the example illustrated, battery 74 is implemented by 9, rechargeable 1.2 volt AAA batteries connected in series. Battery 74 may be recharged by power supplied from plug P2 through jack J2.

Speech synthesizer U2 may be implemented by the speech synthesizer circuit sold under the part number "ISD 1000A" by Tandy Corporation. Speech synthesizer U2 includes an electrically erasable, programmable, read-only memory (EEPROM) for storing digitized voice data. Such digital voice data may be stored in EEPROM by using an analog to digital converter (that also includes signal conditioning circuits) within speech synthesizer U2. Such a digitized voice signal stored within speech synthesizer U2 represents an appropriate recorded message. In a preferred mode of use, this message may be "police—police—police," or any other suitable pre-recorded message. Several seconds of silence can be recorded before the actual message. This period of silence gives one a chance to throw the device after applying power without the device beginning to play its pre-recorded message. In other embodiments, a delay circuit can delay the playing of the pre-recorded message for a user specified amount of time, or, a shock sensor can be included to delay the playing of the pre-recorded message until the device receives a shock such as being thrown through a window and landing on the floor. Speech synthesizer U2 may be reprogrammed with an alternate message, but no reprogramming facilities, such as an input microphone, are illustrated in FIG. 4. In other embodiments, the pre-recorded message may be stored as an analog signal on a magnetic medium, such as on a magnetic tape.

Because speech synthesizer U2 typically operates with a five-volt power supply, voltage regulator U1 is provided to convert the 10.8 volt output of battery 74 to a more suitable five-volt power source.

The output of speech synthesizer U2 is capacitively coupled to the input of amplifier circuit 72. Within amplifier circuit 72, power amplifiers U3 and U4 are configured in a push-pull amplifier arrangement. As shown in the embodiment of FIG. 4, power amplifiers U3 and U4 may be implemented by the power amplifier sold under the part number "LM383" by National Semiconductor.

Resistors R1 through R8 and capacitors C5 through C12 are used to set the signal gain and operating characteristics of amplifier circuit 72. For example, resistors R1 and R2 are used to set the amplifier gain of power amplifier U3. Similarly, resistors R5 and R6 set the gain for power amplifier U4. Resistor R3 in series with C8 and resistor R4 in series with C9 provide high-pass filters for stability of amplifiers U3 and U4, respectively. This is necessary to prevent ringing and oscillation of the output circuit. Capacitors C6 and C10 condition the power supplied to power amplifiers U3 and U4. Capacitor C5 capacitively couples the input signal from speech synthesizer U2 to power amplifier U3. Resistor R7 and variable resistor R8 are provided to balance the power to amplifiers U3 and U4. This ensures that no DC component is present to speaker horn 70. DC components absorb power from the circuit and prevent maximum power from being delivered to speaker horn 70.

For further information regarding amplifier circuit 72, see National Semiconductor Linear Databook Volume 3.

Speaker horn 70 is implemented with a speaker that is "sensitive" in the frequency range between 400 Hz and 7,000 Hz. In a preferred embodiment of the present invention, speaker horn 70 may be implemented by a speaker sold by Mouser Electronics, 2401 Hwy 287 N., Mansfield, Tex. 76063.

While we have shown our invention in only one of its forms, it is not thus limited but is susceptible to various changes and modifications without departing from the spirit thereof.

We claim:

1. An audio identification and distraction device adapted to be passed by law enforcement personnel through a window onto the floor of a structure subject to search and seizure, comprising:

a housing constructed at least partially of a material having a hardness to break a glass window at a low impact velocity, the housing having an elongated central portion, a speaker cap on one end to cover a speaker and protect it from impact, and a handle on the other end;

a voice message storage device in the housing having a police identifying message;

a battery operated power supply inside the housing;

an amplifier inside the housing to receive and amplify the output of the voice message storage device;

a speaker supported in the housing to receive the output of the amplifier circuit;

said amplifier and said speaker generating a high volume audio signal;

said voice message storage device, said battery operated power supply, said amplifier, and said speaker being mounted in the housing to withstand the shock of impact with said glass and said floor of said structure.

2. The invention defined by claim 1 where said audio signal output achieves a speaker volume of at least 100 decibels.

3. The invention defined by claim 1 wherein said speaker volume is a range from 110 to 112 decibels.

4. The invention defined by claim 1 which comprises a jack electrically connected to said battery pack and adapted for releasable connection with a recharging circuit.

5. The invention defined by claim 1 wherein said speaker has an axis coincident with a longitudinal axis of the housing, the speaker having an axial dimension and a diameter, the diameter being less than the axial dimension.

6. The invention defined by claim 1 further comprising a switch for activating the device to provide the audio signal, the switch being mounted to the housing adjacent the handle to allow a user to grip the handle and move the switch with one hand.

7. The invention defined by claim 1 wherein said speaker has a resonant cover.

8. The invention defined by claim 1 wherein said voice message storage device is a voice message storage chip, and said police identifying message is digitally stored within said voice message storage chip.

9. The invention defined by claim 8 wherein the housing has a longitudinal axis, a frame located within the housing having a bulkhead perpendicular to the longitudinal axis, and a rod parallel to the longitudinal axis and wherein the voice message storage chip is mounted to the frame.

10. The invention defined by claim 6 wherein said switch has a finger engaging portion and is mounted to the central portion of the housing and moves to an on position by pulling in a direction parallel to the handle.

11. The invention defined by claim 1 wherein the housing has a longitudinal axis, a frame located within the housing having a bulkhead perpendicular to the longitudinal axis wherein the voice message storage device is mounted to the frame, a rod parallel to the longitudinal axis and, and a speaker base perpendicular to the longitudinal axis, wherein the speaker is located on a first side of the speaker base and the circuit board is located on a second side of the speaker base between the speaker base and the bulkhead.

12. The invention defined by claim 1 wherein said housing is tubular and said handle is an elongated member extending coaxially from said housing.

13. The invention defined by claim 1 further comprising a user activated switch and a delay circuit to activate the power supply a selected time after activation.

14. An audio identification and distraction device adapted to be passed by law enforcement personnel through an opening and onto a floor of a structure subject to search and seizure, comprising:

a tubular housing having a longitudinal axis, first and second ends, and a speaker grid opening;

a speaker located in the housing adjacent to the first end, the speaker having a base with a diameter, an axis coinciding with the longitudinal axis and an axial length greater than the diameter;

a frame located within the housing having a bulkhead located at the second end of the housing perpendicular to the longitudinal axis and a rod parallel to the longitudinal axis and extending from the bulkhead to the speaker base;

a voice message circuit in the housing supported by the frame between the bulkhead and the speaker base and having a police identifying message stored therein;

a switch which when moved causes the voice message circuit and the speaker to deliver a loud message.

15. The invention defined by claim 14 further comprising a handle which is an elongated member extending coaxially from the housing.

16. The invention defined by claim 14 wherein the speaker grid opening is on the first end of the housing.

17. The invention defined by claim 15 further comprising a pin attached to the switch for activating the voice message circuit when the pin is pulled, the switch being mounted to the housing adjacent the handle and the pin having a finger receiving portion to allow a user to pull the pin as the device is passed through the opening of the structure.

18. The invention defined by claim 14 further comprising a delay circuit to activate the voice message circuit a selected time after activation by the switch.

19. A method for police audio identification and distraction comprising the steps of:

providing a device having a housing constructed at least partially of a material having a hardness to break a glass window of a structure at a low impact velocity;

providing a voice message storage circuit in the housing having a police identifying message;

providing a battery operated power supply inside the housing;

providing an amplifier inside the housing to receive and amplify the output of the voice message storage circuit;

providing a speaker supported in the housing to receive the output of the amplifier circuit;

mounting the voice message storage circuit, the battery operated power supply, the amplifier, and the speaker in the housing in a manner to withstand the shock of impact with the glass window and falling onto a floor of the structure;

breaking the glass window of the structure with the device;

dropping the device upon the floor; and causing the device to output the message as a high volume audio signal.

20. A method for police audio identification and distraction of occupants within a structure having a glass window and a floor, comprising the steps of:

a) providing a device having a voice message storage circuit having a police identifying message, a battery operated power supply, and a speaker, all supported in the housing;

b) breaking the glass window of the structure with the device, passing the device through the window and allowing the device to fall onto the floor; and c) actuating the voice message storage circuit, thereby causing it to provide the message and to identify the device as law enforcement personnel.

21. The method as defined in claim 20 wherein step c) occurs substantially simultaneously with step of breaking the window.

* * * * *